US006196737B1

(12) United States Patent
Haug

(10) Patent No.: US 6,196,737 B1
(45) Date of Patent: Mar. 6, 2001

(54) THERMAL PRINTING MECHANISM

(76) Inventor: Werner Haug, Oberstrasse 12, CH-3550 Langnau im Emmental (DE)

( * ) Notice: Subject to any disclaimer, the term of this patent is extended or adjusted under 35 U.S.C. 154(b) by 0 days.

(21) Appl. No.: 09/242,841

(22) PCT Filed: Jun. 24, 1998

(86) PCT No.: PCT/CH98/00278

§ 371 Date: Feb. 24, 1999

§ 102(e) Date: Feb. 24, 1999

(87) PCT Pub. No.: WO99/00255

PCT Pub. Date: Jan. 7, 1999

(30) Foreign Application Priority Data

Jun. 27, 1997 (CH) ..... 1553/97

(51) Int. Cl.[7] ..... B41J 33/32

(52) U.S. Cl. ..... 400/248.1; 400/207; 400/234; 400/248

(58) Field of Search ..... 400/248, 248.1, 400/250, 207, 208, 234

(56) References Cited

U.S. PATENT DOCUMENTS

| | | | | |
|---|---|---|---|---|
| 4,352,575 | | 10/1982 | Shore | 400/250 |
| 4,623,274 | * | 11/1986 | Ohsaki | 400/208 |
| 4,753,545 | * | 6/1988 | Kohlhage et al. | 400/208 |
| 4,867,589 | | 9/1989 | Limberger et al. | 400/248 |
| 5,160,205 | * | 11/1992 | Mistyurik | 400/248 |
| 5,195,835 | * | 3/1993 | Collins | 400/207 |
| 5,209,586 | * | 5/1993 | Furrow et al. | 400/196.1 |
| 5,923,357 | * | 7/1999 | Sugimoto et al. | 400/248 X |

FOREIGN PATENT DOCUMENTS

| | | |
|---|---|---|
| 4139504 | 6/1993 | (DE) . |
| 0604142 | 6/1994 | (EP) . |

OTHER PUBLICATIONS

Patent Abstracts of Japan, vol. 013, No. 385 (M–864), Aug. 25, 1989 & JP 01 135680 A (Fuji Kiki Kogyo KK), May 29, 1989.

* cited by examiner

*Primary Examiner*—John S. Hilten
*Assistant Examiner*—Minh H. Chau
(74) *Attorney, Agent, or Firm*—Friedrich Kueffner

(57) ABSTRACT

For printing special symbols, particularly stamps onto letters and packages, increasingly so-called thermal transfer printing methods are used. When inserting the thin transfer ribbon (4) over the printing head (10), the ribbon (4) is frequently partially damaged or even torn. The proposed printing mechanism makes it possible to reduce the time required for exchanging the ribbon (4), on the one hand, and to substantially reduce the damage to the ribbon, on the other hand. The object is met by a guide rod (7) provided on a stirrup (8).

9 Claims, 1 Drawing Sheet

THERMAL PRINTING MECHANISM

BACKGROUND OF THE INVENTION

1. Field of the Invention

The invention relates to a thermal printing mechanism for printing on objects, such as letters, packages and the like, with a ribbon portion formed by a ribbon which can be transported in a cassette from a first spool onto an adjacent driveable second spool, wherein the ribbon portion can be inserted between a printing head and an adjustable counter-abutment which can be driven for conveying the ribbon, and wherein the ribbon portion is at least partially supported during printing on the objects by the counter-abutment and the printing head acts on the ribbon portion.

2. Description of the Related Art

Thermal printing mechanisms are used for printing special symbols, particularly stamps, onto objects, such as letters, packages and the like, which may vary within a wide range with respect to their geometry, surface properties and other characteristic variables.

The pressure transfer ribbons used in this connection are in most cases stored on spools in cassettes. For the printing process, the cassettes are moved into a predefined position relative to the printing head of the printing mechanism, so that the ribbon is located on the printing surface.

When the cassette is inserted, the ribbon which is very thin or the ribbon portion formed between the spools is frequently injured or damaged by the printing head.

SUMMARY OF THE INVENTION

It is the object of the present invention to propose means which eliminate these disadvantages. Simultaneously, the time required for inserting a new cassette should be reduced.

In the following, a franking machine is proposed as a use of the printing mechanism; in the franking machine, a cassette can be easily exchanged when the ribbon is exchanged or the printing mechanism can be easily retrofitted.

The above-mentioned object is met in accordance with the present invention by providing the cassette with means for moving the ribbon portion stretched between the spools prior to the insertion thereof between the printing head and the counter-abutment into an inoperative position which is remote from the printing head and the counter-abutment. The advantage of the printing mechanism according to the invention is primarily seen in the simplicity of operation.

Before the cassette is inserted into the printing mechanism, the ribbon portion on which the stirrup or the guide rod can act must be in the inserted position.

The guide rod keeps the ribbon away from the printing position. After the cassette has been completely mounted, the guide rod is moved by the moveable stirrup into a position of rest in which the ribbon is not contacted by the guide rod and rests in the area of the ribbon portion against the printing head.

In the following, an embodiment of the invention will be explained in more detail with the aid of the drawing.

DESCRIPTION OF THE PREFERRED EMBODIMENT

Figure 3:
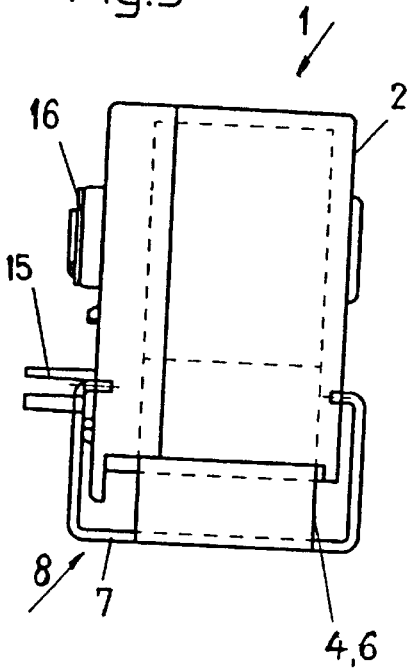
FIG. 3 is a side view of the cassette according to FIGS. 1 and 2.
Figure 1:
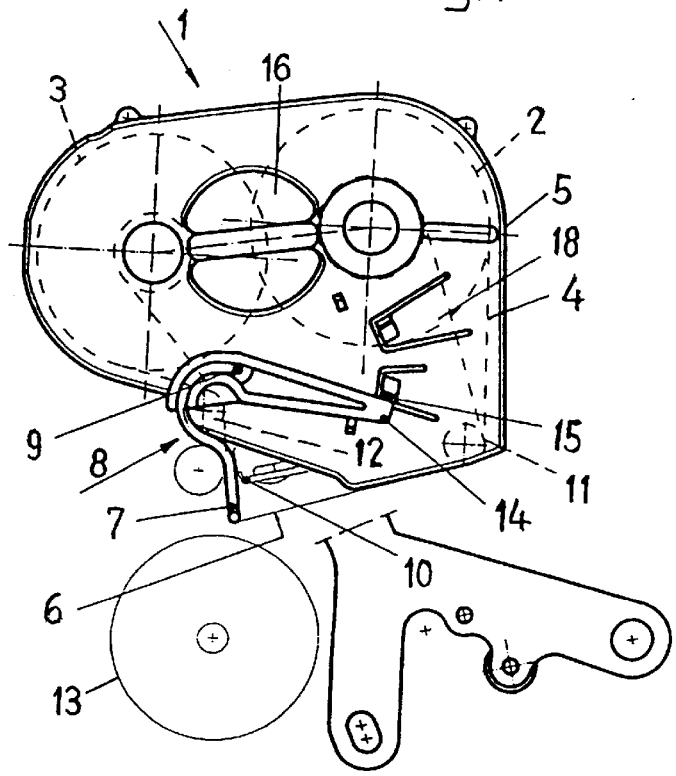
FIG. 1 is a view of the cassette during the insertion into a printing mechanism.

FIG. 1 shows a cassette 1 during the insertion phase thereof into a printing mechanism (partially illustrated), wherein two adjacent spools 2, 3 for alternatingly winding and unwinding a pressure transfer ribbon 4, particularly a thermal pressure transfer ribbon, are mounted in the housing 5 of the cassette 1. The ribbon 4 forms between the spools 2, 3 a ribbon portion 6 which is lifted from the printing head 10 of a corner-edge printing head by means of a stirrup 8 which has a guide rod 7 and is pivotable about an axis 9; the stirrup 8 could also be constructed so as to be slidable.

The ribbon portion 6 extends indirectly between the spools 2, 3 from a deflection roller 11 to a guide roller 12 where the ribbon 4 is deflected to a greater or lesser extent; the printing head 10 is arranged between the deflection roller 11 and the guide roller 12.

FIG. 1 shows the ribbon 4 in a position raised from the printing head 10 in which the ribbon 4 can be inserted and removed unimpededly parallel to the axes of the spools 2, 3 at a distance from a counter-abutment 13 constructed as a driven conveying roller. In this situation, the stirrup 8 is locked by a lever 14 in a notch 15.

Using a handle 16, the cassette 1 can be pushed into an insertion device of the printing mechanism and can be removed therefrom.

Figure 2:
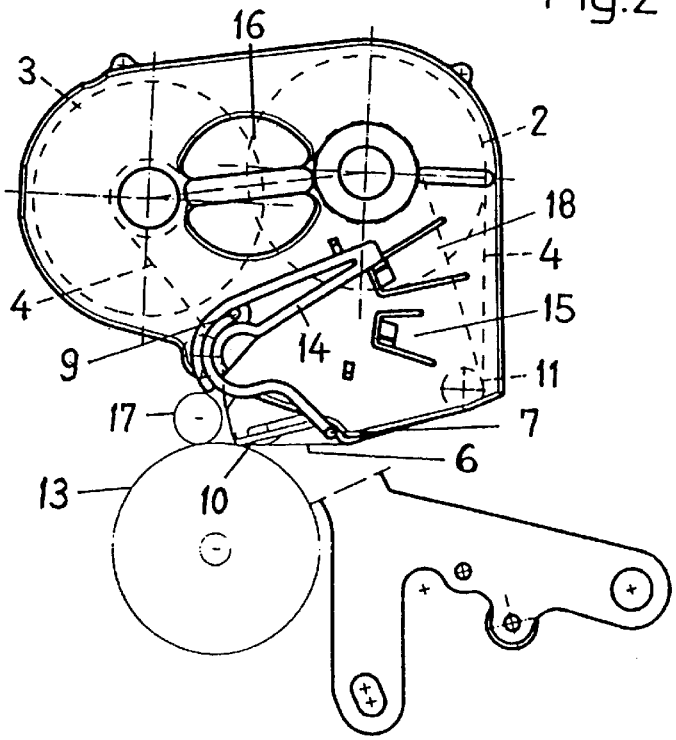
FIG. 2 is a view of the cassette of FIG. 1 shown in the position of operation in the printing mechanism.

For transporting the objects to be printed, the illustrated stationary rotatable roller 17 is provided which forms with the conveying roller 13 during the printing process a feeding gap (see also FIG. 2).

In FIG. 2, the cassette 1 is in the final position of operation in the printing mechanism. By the stirrup 8 which has been pivoted back from the raised position into a second notch 18, the ribbon 4 has been placed or returned in the area of the ribbon portion 6 against the printing head 10, wherein the guide rod 7 assumes a position of rest at the cassette housing 5 in which the guide rod 7 is located at a distance from the ribbon 4 or the ribbon portion 6.

The counter-abutment 13 and the printing head 10 hold the ribbon 4 or the stretched ribbon portion 6 so as to be tensioned; the distance between the counter-abutment 13 and the roller 17 is closed so as to convey the ribbon.

In the printing position, the ribbon 4 or the ribbon portion 6 extends at an approximately right angle around the printing edge of the printing head. How the printing ribbon extends on the printing head is known and, therefore, will not be described in more detail.

For reaching the two positions of the ribbon portion 6, the stirrup 8 can be equipped with an actuating grip, wherein, for example, the lever 14 is provided for the grip.

The stirrup 8 could also be constructed so as to be controllable in a forced manner, such that when the cassette 1 is inserted into the printing mechanism or is removed therefrom, the guide rod 7 is controlled by an insertion device at the printing mechanism into a position of the ribbon portion 6 which is raised from the printing head 10.

In a reverse arrangement, the stirrup 8 could be constructed so as to be displaceable or automatically displaceable into the rearwardly offset position of rest of the guide rod 7 when the cassette 1 is removed from the printing mechanism.

In order to avoid injury to the pressure transfer ribbon 4, the cassette 1 may include a safety element constructed as a tracer which prevents an insertion of the cassette into the insertion device of the printing mechanism when the guide rod 7 is in its rearwardly offset position.

The printing mechanism according to the invention is particularly suitable for use in a franking machine.

What is claimed is:

1. Thermal printing mechanism for printing on objects, with a ribbon portion (6) formed by a printing ribbon (4) configured to be transported in a cassette (1) from a first spool (2, 3) onto an adjacent drivable second spool (3, 2), wherein the ribbon portion (6) is configured to be inserted between a printing head (10) and an adjustable counter-abutment (13) configured to be driven for conveying the objects, wherein the ribbon portion (6) is at least partially supported by the counter-abutment (13) and the printing head (10) acts on the ribbon portion (6) when printing the objects, wherein the cassette (1) is provided with means for moving the ribbon portion (6) stretched between the spools (2, 3) prior to insertion between the printing head (10) and the counter-abutment (13) into an inoperative position remote from the printing head (10) and the counter abutment (13), wherein the means for moving the ribbon portion (6) is a stirrup (8) moveably guided on the cassette housing (5) or pivotably mounted on the cassette housing (5) about an axis extending parallel to the axes of rotation of the spools, wherein the stirrup (8) has at the protruding or pivotable end thereof a guide rod (7) configured to act on the ribbon portion (6) at the inner side and over the width of the ribbon when the stirrup (8) is actuated.

2. Printing mechanism according to claim 1, comprising a guide roller (12) arranged downstream of the second spool (3, 2) and comprising a corner-edge printing head in which the ribbon (4) during printing of an object extends around the corner edge of the printing head (10) and around the guide roller (12).

3. Printing mechanism according to claim 1, wherein the guide rod (7) is configured to be locked in the printing position of the ribbon portion (6) in a position of rest which is rearwardly offset from the ribbon (4).

4. Printing mechanism according to claim 3, wherein the cassette housing has a notch (18) configured to lock the stirrup (8) and wherein the position of rest of the guide rod (7) is determined by the notch (18) locking the stirrup (8).

5. Printing mechanism according to claim 1, wherein the cassette housing has an additional notch (15) arranged offset on the cassette housing and wherein, when the ribbon (4) or ribbon portion (6) is in the position remote from the printing head (10), the additional notch (15) locks the guide rod (7).

6. Printing mechanism according to claim 1, comprising an actuating grip connected to the stirrup (8).

7. Printing mechanism according to claim 1, wherein the stirrup (8) is configured to be movable in a forcibly controlled manner, such that, when the cassette (1) is inserted into the printing mechanism or is removed from the printing mechanism, the guide rod (7) is moved into the offset position of the ribbon portion (6).

8. Printing mechanism according to claim 1, wherein the stirrup (8) is configured to be movable or automatically movable into the rearwardly offset position of rest of the guide rod (7) when the cassette (1) is not inserted.

9. Use of a printing mechanism according to claim 1 in a franking machine.

* * * * *